US007531732B2

(12) United States Patent
Dunlop

(10) Patent No.: US 7,531,732 B2
(45) Date of Patent: May 12, 2009

(54) GUITAR MUSIC SHEET HOLDER

(76) Inventor: Jim Dunlop, P.O. Box 846, Benicia, CA (US) 94510

( * ) Notice: Subject to any disclaimer, the term of this patent is extended or adjusted under 35 U.S.C. 154(b) by 0 days.

(21) Appl. No.: 11/585,495

(22) Filed: Oct. 24, 2006

(65) Prior Publication Data

US 2008/0092717 A1 Apr. 24, 2008

(51) Int. Cl.
*G10D 3/00* (2006.01)
*G10G 7/00* (2006.01)

(52) U.S. Cl. ..... 84/329; 248/443

(58) Field of Classification Search ..... 84/329; 248/443

See application file for complete search history.

(56) References Cited

U.S. PATENT DOCUMENTS

| | | | | | |
|---|---|---|---|---|---|
| 487,820 | A * | 12/1892 | Benson | 248/443 |
| 596,729 | A * | 1/1898 | White | 248/122.1 |
| 608,438 | A * | 8/1898 | Bye | 248/443 |
| 952,495 | A * | 3/1910 | Austin | 248/205.8 |
| 1,455,441 | A * | 5/1923 | La Hodny | 248/484 |
| 2,442,736 | A * | 6/1948 | Valentine | 248/124.2 |
| 2,527,899 | A * | 10/1950 | Valasek | 248/206.1 |
| 2,546,757 | A * | 3/1951 | Krarup | 248/443 |
| 2,650,788 | A * | 9/1953 | Hulstein | 248/231.71 |
| 2,710,609 | A * | 6/1955 | Giller | 600/247 |
| 3,194,406 | A * | 7/1965 | Simeti et al. | 211/100 |
| 3,843,083 | A * | 10/1974 | Angibaud | 248/229.14 |
| 3,946,980 | A * | 3/1976 | Tamarkin | 248/443 |
| 3,948,476 | A * | 4/1976 | Kuniyosi | 248/443 |
| 4,321,660 | A * | 3/1982 | Sokol | 362/368 |
| 4,501,403 | A * | 2/1985 | Goodrich | 248/443 |
| 4,832,302 | A * | 5/1989 | Anderson et al. | 248/443 |
| 5,845,885 | A * | 12/1998 | Carnevali | 248/181.1 |
| 5,847,298 | A * | 12/1998 | Adams | 84/314 R |
| 6,406,407 | B1 * | 6/2002 | Wiedmann et al. | 482/82 |
| 6,459,023 | B1 | 10/2002 | Chandler | |
| 6,502,794 | B1 * | 1/2003 | Ting | 248/206.2 |
| 6,666,420 | B1 * | 12/2003 | Carnevali | 248/205.8 |

(Continued)

OTHER PUBLICATIONS

About National Products, Inc, founded in 1994 by Jeff Carnevali, http://www.ram-mount.com/company/aboutnpi.htm, viewed Nov. 27, 2007; RAM Mount Catalog, pp. 2, 24, 43 and 99. http://www.ram-mount.com/pdf/universal.pdf, viewed Nov. 27, 2007.*

(Continued)

*Primary Examiner*—Jeffrey Donels
*Assistant Examiner*—Robert W Horn
(74) *Attorney, Agent, or Firm*—West and Associates, A PC; Stuart J. West; Charlotte Rodeen-Dickert

(57) ABSTRACT

A sheet music holder comprises a golpe board with a non-porous surface for gluing onto a guitar body with a porous surface, a twist lock power-assisted suction device, a clamp with a single tightening nut, and a sheet tray to hold the sheet music. The twist lock power-assisted suction device allows a user to easily create a strong vacuum attachment that will last for hours so a complete performance will not be interrupted. The golpe board is included where the guitar body has a porous surface that would otherwise frustrate the suction attachment. The double-ball and socket clamp and arm allows a variety of positioning possibilities for the user to best read the sheet music in the tray.

8 Claims, 3 Drawing Sheets

U.S. PATENT DOCUMENTS

| | | | | |
|---|---|---|---|---|
| D490,498 | S * | 5/2004 | Golichowski | D23/213 |
| 6,946,591 | B2 * | 9/2005 | Lee | 84/177 |
| 7,021,593 | B1 * | 4/2006 | Fan | 248/206.2 |
| 7,090,181 | B2 * | 8/2006 | Biba et al. | 248/288.31 |
| 7,219,867 | B2 * | 5/2007 | Kalis et al. | 248/288.31 |
| 7,277,240 | B2 * | 10/2007 | Carnevali | 359/802 |
| 7,460,007 | B2 * | 12/2008 | Schofield et al. | 340/438 |
| 2006/0086872 | A1 | 4/2006 | Fan | |
| 2008/0092717 | A1 * | 4/2008 | Dunlop | 84/329 |
| 2009/0000457 | A1 * | 1/2009 | Dunlop | 84/329 |

OTHER PUBLICATIONS

Faucher, François, "Classical Guitar Illustrated History: History of Flamenco," © 1998-2007, http://www.classicalguitarmidi.com/history/flamenco.html, viewed Nov. 27, 2007.*

Flamenco Tap Plates (golpeadores), illustrated golpe plate, http://www.fernandezmusic.com/Flamencotapplates.html, viewed Nov. 27, 2007.*

Fine Guitar Consultants Classical Guitar, describing 2001 guitar with golpe tap plates, http:www.fineguitarconsultants.com/classical2.htm, viewed Nov. 27, 2007.*

* cited by examiner

GUITAR MUSIC SHEET HOLDER

BACKGROUND OF THE INVENTION

1. Field of the Invention

The present invention relates to musical instruments, and in particular to methods, systems, and devices for holding sheet music on an instrument where an artist can read it during a musical performance.

2. Description of the Prior Art

Sheet music is rather awkward to hold and read while trying to play a musical instrument like a guitar. But being able to read the music while playing the instrument is a critical necessity. Sheet music stands are very familiar to most people, but such take up floor space, are top heavy, easily knocked over, and restrict the movements of the performer.

Attempts have been made to attach holders to guitars before, but the kind that clamp-on are heavy and can mar the instrument, and other devices that use suction cups don't really attach in a satisfactory fashion or remain in place for an acceptable period of time. Often the surfaces of the guitar are a little porous, and defeat any suction device applied. Other suction devices are cheap and flimsy, and just don't apply a high enough vacuum to really keep the attachment firmly in place. See, for example, United States Patent 3,948,476 to Shiniti Kunyosi.

SUMMARY OF THE INVENTION

Briefly, a sheet music holder embodiment of the present invention comprises a golpe board of non-porous material for gluing onto a guitar body should the surface be porous, a twist lock suction device that is power-assisted for maximum consistent suction, a clamp with a single tightening nut, and a sheet tray to hold the sheet music. The twist lock power-assisted suction device allows a user to easily create a strong vacuum attachment that will last for hours. The non-porous golpe board is included where the guitar body has a porous surface that would otherwise frustrate the suction attachment. The double-ball and socket clamp and arm allows a variety of positioning possibilities for the user to best read the sheet music in the tray.

An advantage of the present invention is that a sheet music holder is provided that is easy to use.

Another advantage of the present invention is that a sheet music holder is provided that will not mar a musical instrument even after repeated uses.

A further advantage of the present invention is that a sheet music holder is provided that will stay fastened for many hours and not slip off accidentally thanks to a twist-lock action in the power-assisted suction device.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

Figure 1:
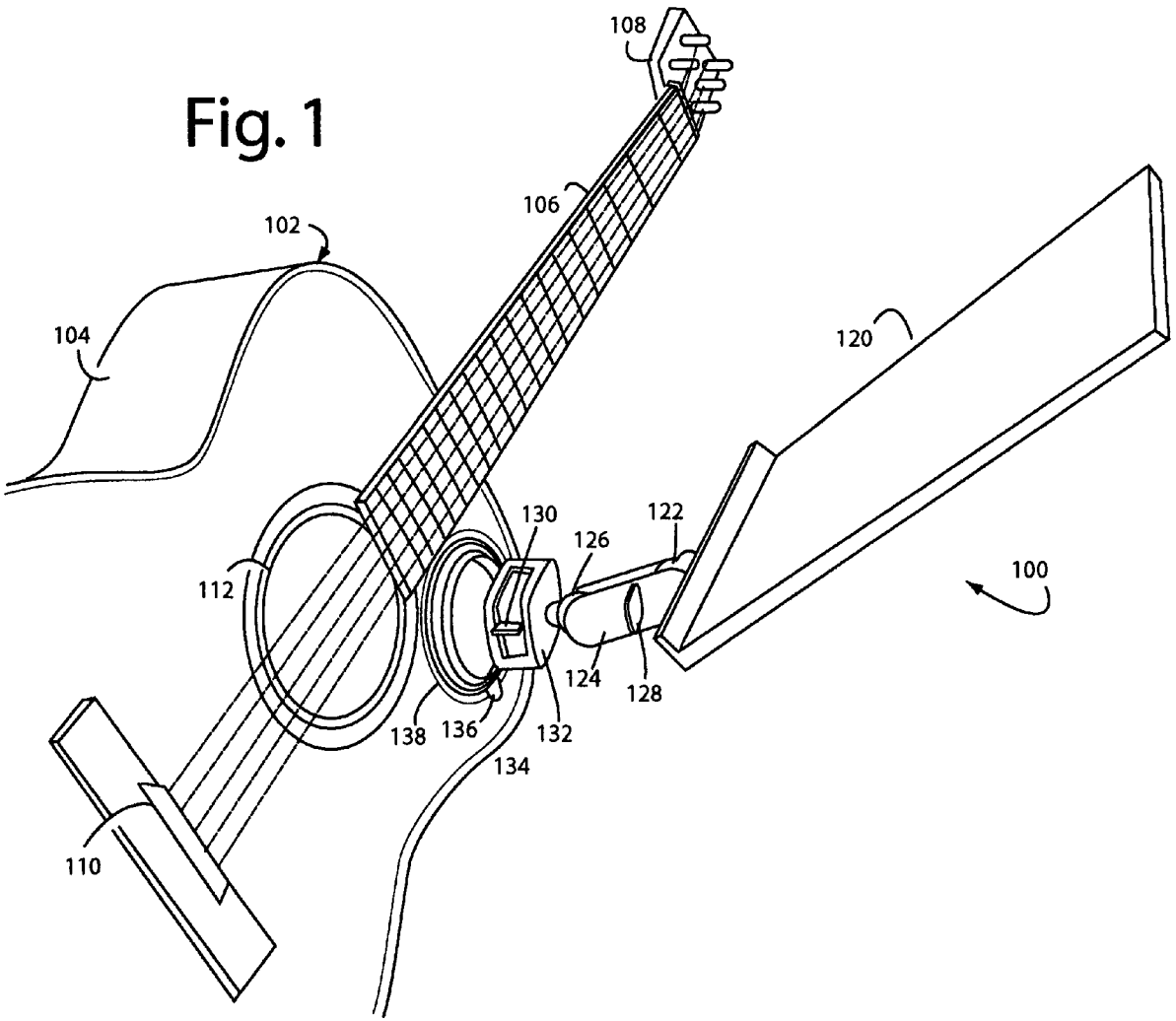
FIG. 1 is a perspective diagram of a sheet music holder embodiment of the present invention that is attached, as an example, to an acoustic guitar.

FIG. 1 represents a sheet music holder embodiment of the present invention, and is referred to herein by the general reference numeral 100. The sheet music holder 100 attaches, for example, to an acoustic guitar 102 comprising a body 104, a fret board 106, a key head 108, a bridge 110, and a sounding hole 112. The sheet music holder 100 itself comprises a sheet holding tray 120 with a tray clamp ball 122 joined by a clamp assembly 124 to a base clamp ball 126 and tightened with a handle 128. A power-assisted suction base has an activation lever 130 inside a base housing 132 that draws the base tight onto the guitar. A release tab 134 allows a quick release of suction cup 136 against a non-porous surface. A non-porous surfaced golpe board 138 is used if the instrument itself has a porous surface. The clamp assembly 124 allows a user to position the holding tray 120 with sheet music just about in any tilt or angle that is comfortable. The tray clamp ball 122 and base clam ball 126 are snuggled with the clamp assembly 124, the tray 120 is positioned as desired, and then the clamp is fully tightened.

The golpe board 138 is attached to the board 104, e.g., with adhesives, and provides a high quality, non-porous surface for vacuum cup attachment. Traditionally, golpe boards are attached to guitars for flamenco music performances where the guitar body is subject to heavy tapping that could damage the soft wood and finishes. If the guitar body 104 already has a suitable surface, the golpe board 138 is not needed and may be omitted.

The suction base and clamp assembly may be a National Products, Inc., type RAM-B-101-2241U, RAM-MOUNT with twist lock cup. The twist lock power-assisted suction device is described by Jeffrey Carnevali in United States Patent 6,666,420, issued Dec. 23, 2003, and incorporated herein by reference.

Figure 2:
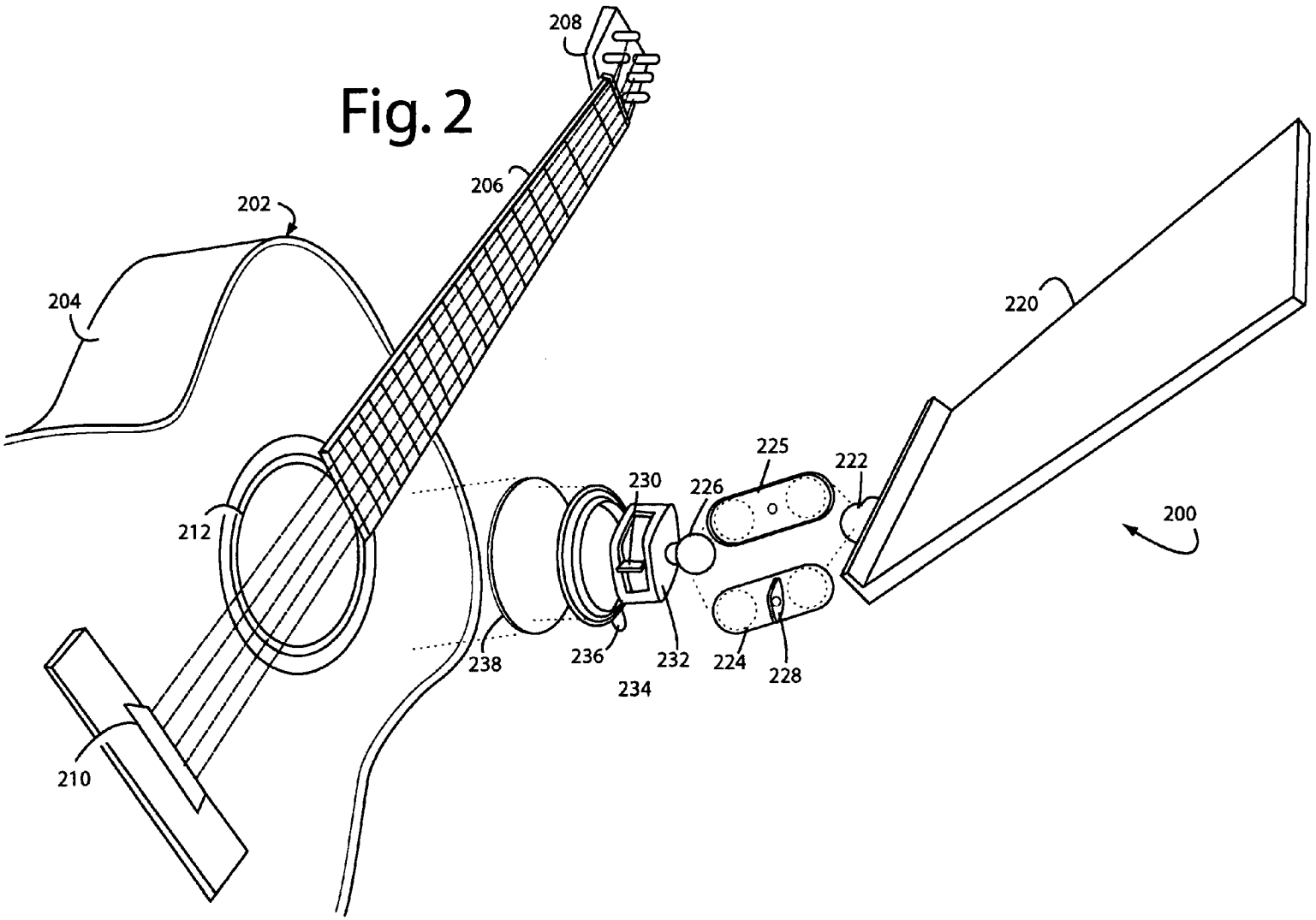
FIG. 2 is an exploded assembly diagram of the sheet music holder of FIG. 1 showing how the pieces come together and attach to the acoustic guitar.

FIG. 2 represents a sheet music holder assembly, and is referred to herein by the general reference numeral 200. The sheet music holder 200 attaches to a musical instrument or nearby surface. If an acoustic guitar 202, such comprises a body 204, a fret board 206, a key head 208, a bridge 210, and a sounding hole 212. The sheet music holder 200 itself comprises a sheet holding tray 220 with a tray clamp ball 222. A pair of clamp shells 224 and 225, with ball sockets, captures tray clamp ball 222 and a similar base clamp ball 226. They are simultaneously tightened around both balls 222 and 226 with a single T-handle tightening nut 228 on a bolt. A suction base has an activation lever 230 inside a base housing 232 that draws the base tight onto a non-porous surface. A release tab 234 allows a quick release of suction cup 236, e.g., against a golpe board 238 that was glued to the guitar body 204. The clamp assembly 224 allows a user to position the holding tray 220 with sheet music just about in any tilt or angle that is comfortable.

Figure 3:
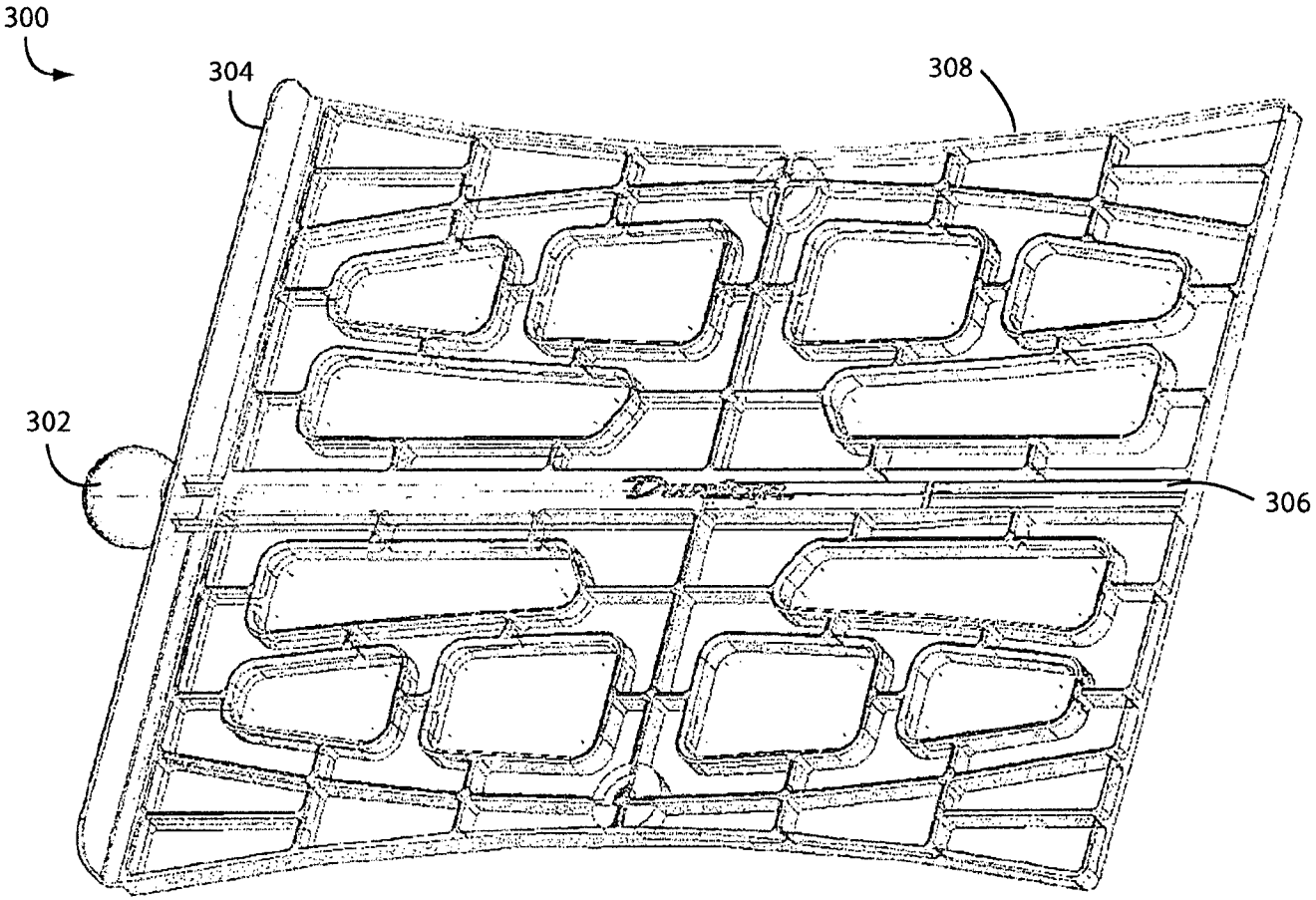
FIG. 3 is a perspective view diagram of a decorative type of sheet music tray that could be included in the holders illustrated in FIGS. 1 and 2.

FIG. 3 shows a music sheet tray 300 with a particular decorative design that provides maximum surface area and strength with a minimum of weight. Of course, other designs could be used. The tray 300 comprises a tray clamp ball 302 to fit into a clamp as shown in FIGS. 1 and 2. A lip 304 provides a bottom support for sheets of paper, e.g., sheet music. The tray clamp ball 302 and base clamp ball are preferably about the same size diameter. A back 308 would be visible to an audience, and a backbone 306 provides added strength such as would be needed in a plastic injection molded implementation.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A sheet music holder, comprising:

a power-assisted suction device for temporary attachment to a hollow-bodied musical instrument;

wherein said power-assisted suction device engages a single surface of the hollow-bodied musical instrument over a continuous area;

a golpe board having a non-porous first surface and a non-porous second surface;

said first surface of said golpe board being attached to the hollow-bodied musical instrument;

said second surface of said golpe board providing a non-porous surface for temporary attachment of said power-assisted suction device to the musical instrument without marring;

a base clamp ball attached to the power-assisted suction device;

a tray for holding sheets of music for a musician to read during a performance of said musical instrument;

a tray clamp ball attached to said tray; and a clamp adapted to capture said base clamp ball and said tray clamp ball, wherein said clamp allows adjustment of the tilt and angle of the tray relative to the musical instrument.

2. The sheet music holder of claim 1, further comprising:

a twist lock included in the suction device for increasing the holding power and thereby increasing the time of temporary attachment into a range of hours.

3. The sheet music holder of claim 1, wherein the musical instrument is a guitar.

4. The sheet music holder of claim 1, wherein the musical instrument is an acoustic guitar and the suction device is attached to the guitar body near the fret board.

5. The sheet music holder of claim 1, wherein the tray clamp ball is located near the center of the tray at the bottom.

6. The sheet music holder of claim 1, wherein the base clamp ball is located at the top of the suction device.

7. A kit, comprising:

a power-assisted suction device for temporary attachment to a hollow-bodied musical instrument;

a golpe board having a non-porous first surface and a non-porous second surface;

said first surface of said golpe board adapted to attach to the hollow-bodied musical instrument;

said second surface of said golpe board providing a non-porous surface adapted to temporarily attach said power-assisted suction device to the musical instrument;

a base clamp ball adapted to attach to said power-assisted suction device;

a tray for holding sheets of music in a selectable geometric configuration relative to the hollow-bodied musical instrument;

a tray clamp ball adapted to attach to said tray; and a clamp adapted to selectively engage said base clamp ball and said tray clamp ball, wherein said clamp allows adjustment of the tilt and angle of the tray relative to the musical instrument.

8. A kit, comprising:

a power-assisted suction device for temporary attachment to a hollow-bodied musical instrument;

a golpe board having a non-porous first surface and a non-porous second surface;

said first surface of said golpe board adapted to attach to the hollow-bodied musical instrument;

said second surface of said golpe board providing a non-porous surface adapted to temporarily attach said power-assisted suction device to the musical instrument;

a base clamp ball adapted to attach to said power-assisted suction device;

a tray for holding sheets of music;

a tray clamp ball adapted to attach to said tray; and a clamp adapted to selectively engage said base clamp ball and said tray clamp ball in a selectable geometric configuration relative to the hollow-bodied musical instrument.

* * * * *